US008656612B2

(12) United States Patent
Hurd et al.

(10) Patent No.: US 8,656,612 B2
(45) **Date of Patent: *Feb. 25, 2014**

(54) FOOTWEAR WITH COUNTER-SUPPLEMENTING STRAP

(75) Inventors: John Hurd, Tigard, OR (US); Matthew A. Nurse, Lake Oswego, OR (US)

(73) Assignee: NIKE, Inc., Beaverton, OR (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/613,383

(22) Filed: Sep. 13, 2012

(65) Prior Publication Data

US 2013/0000150 A1 Jan. 3, 2013

Related U.S. Application Data

(63) Continuation of application No. 12/621,128, filed on Nov. 18, 2009, now Pat. No. 8,302,329.

(51) Int. Cl.
*A43B 7/20* (2006.01)

(52) U.S. Cl.
USPC ..... 36/88; 36/89; 36/92; 36/68; 36/69

(58) Field of Classification Search
USPC ..... 36/88, 89, 92, 107, 114, 68, 69, 29, 36/50.1
See application file for complete search history.

(56) References Cited

U.S. PATENT DOCUMENTS

| | | | |
|---|---|---|---|
| 643,998 | A | 2/1900 | Batchelor |
| 744,798 | A | 11/1903 | Roberts |
| 2,038,151 | A | 4/1936 | Wernmark |
| 2,090,675 | A | 8/1937 | Hadaway |
| 2,112,884 | A | 4/1938 | Gillette et al. |
| 2,259,273 | A | 10/1941 | Smith |
| 2,367,092 | A | 1/1945 | Blotner |
| 2,451,372 | A | 10/1948 | Ballenger |
| 2,590,648 | A | 3/1952 | Pitz |
| 2,642,677 | A | 6/1953 | Yates |
| 2,660,812 | A | 12/1953 | Henke |

(Continued)

FOREIGN PATENT DOCUMENTS

| | | |
|---|---|---|
| CH | 678794 | 11/1991 |
| DE | 3506057 | 2/1986 |

(Continued)

OTHER PUBLICATIONS

International Search Report and Written Opinion for PCT/US2010/054399 dated Jan. 21, 2011.

*Primary Examiner* — Marie Patterson
(74) *Attorney, Agent, or Firm* — Banner & Witcoff, Ltd.

(57) ABSTRACT

A heel cup formed from a flexible material is located under the heel region of an upper portion of an article of footwear. Lateral and medial counters extend upward from the heel cup on the lateral and medial sides, with the medial counter having a height less than that of the lateral counter, and with a rear edge of the heel cup being lower than the lateral and medial counters. A rear strap extends upward around the lateral counter and around the Achilles tendon of the wearer, and is secured to a location on the upper that is forward of the wearer's ankle. During cutting movements in which the article is worn on the outside foot, tilting of the wearer foot and ankle toward the medial side pulls the strap and causes the lateral counter to conform to and support the wearer heel.

22 Claims, 11 Drawing Sheets

(56) References Cited

U.S. PATENT DOCUMENTS

| | | | |
|---|---|---|---|
| 2,680,309 | A | 6/1954 | Peterson |
| 2,936,536 | A | 5/1960 | Blustein |
| 3,001,302 | A | 9/1961 | Farley |
| 3,066,678 | A | 12/1962 | Riecken |
| D205,993 | S | 10/1966 | Ali |
| 3,352,033 | A | 11/1967 | Colley |
| D217,217 | S | 4/1970 | Evind |
| 3,522,668 | A | 8/1970 | Fesl |
| 3,597,862 | A | 8/1971 | Vogel |
| 3,659,361 | A | 5/1972 | White, Sr. |
| 3,678,604 | A | 7/1972 | Levine |
| 3,977,098 | A | 8/1976 | Chalmers |
| 4,045,888 | A | 9/1977 | Oxenberg |
| 4,142,307 | A | 3/1979 | Martin |
| 4,200,997 | A | 5/1980 | Scheinhaus et al. |
| D255,396 | S | 6/1980 | Scheinhaus et al. |
| 4,255,877 | A | 3/1981 | Bowerman |
| 4,282,657 | A | 8/1981 | Antonious |
| 4,282,659 | A | 8/1981 | Bourque et al. |
| 4,366,634 | A | 1/1983 | Giese et al. |
| 4,428,130 | A | 1/1984 | Perotto |
| 4,446,633 | A | 5/1984 | Scheinhaus et al. |
| 4,513,520 | A | 4/1985 | Koch |
| 4,547,981 | A | 10/1985 | Thais et al. |
| 4,577,419 | A | 3/1986 | Chassaing |
| 4,577,421 | A | 3/1986 | Sartor |
| 4,616,524 | A | 10/1986 | Bidoia |
| 4,620,378 | A | 11/1986 | Sartor |
| 4,622,763 | A | 11/1986 | Adams |
| 4,624,064 | A | 11/1986 | Pozzebon |
| 4,644,671 | A | 2/1987 | Walkhoff |
| 4,679,334 | A | 7/1987 | McBride |
| 4,698,922 | A | 10/1987 | Sartor |
| 4,719,709 | A | 1/1988 | Vaccari |
| 4,724,626 | A | 2/1988 | Baggio |
| 4,811,498 | A | 3/1989 | Barret |
| 4,811,503 | A | 3/1989 | Iwama |
| 4,817,302 | A | 4/1989 | Saltsman |
| 4,821,430 | A | 4/1989 | Flemming et al. |
| 4,869,000 | A | 9/1989 | York, Jr. |
| 4,878,504 | A | 11/1989 | Nelson |
| 4,922,630 | A | 5/1990 | Robinson |
| 4,972,613 | A | 11/1990 | Loveder |
| 5,056,241 | A | 10/1991 | Young |
| 5,386,649 | A | 2/1995 | Paris |
| 5,400,529 | A | 3/1995 | Bell et al. |
| 5,477,593 | A | 12/1995 | Leick |
| 5,499,461 | A | 3/1996 | Danezin et al. |
| 5,509,217 | A | 4/1996 | Condini |
| 5,544,433 | A | 8/1996 | Borsoi et al. |
| 5,566,474 | A | 10/1996 | Leick et al. |
| 5,575,015 | A | 11/1996 | Paris et al. |
| 5,701,689 | A | 12/1997 | Hansen et al. |
| 5,724,680 | A | 3/1998 | Cesnick et al. |
| 5,775,006 | A | 7/1998 | Breuner |
| 5,819,439 | A | 10/1998 | Sanchez |
| 5,836,094 | A | 11/1998 | Figel |
| 5,906,058 | A | 5/1999 | Rench et al. |
| 5,933,987 | A | 8/1999 | Demarchi |
| 5,937,542 | A | 8/1999 | Bourdeau |
| 5,937,543 | A | 8/1999 | Hall et al. |
| 5,992,057 | A | 11/1999 | Monti |
| 6,021,585 | A | 2/2000 | Cole |
| 6,021,589 | A | 2/2000 | Cagliari et al. |
| 6,076,285 | A | 6/2000 | Caeran et al. |
| 6,138,384 | A | 10/2000 | Messmer |
| 6,170,175 | B1 | 1/2001 | Funk |
| 6,226,898 | B1 | 5/2001 | Trimble et al. |
| 6,237,254 | B1 | 5/2001 | Rork et al. |
| 6,272,772 | B1 | 8/2001 | Sherman |
| 6,276,708 | B1 | 8/2001 | Hogstedt |
| 6,295,743 | B1 | 10/2001 | Brooks |
| 6,405,457 | B1 | 6/2002 | Basso et al. |
| 6,467,193 | B1 | 10/2002 | Okajima |
| 6,467,195 | B2 | 10/2002 | Pierre et al. |
| 6,499,234 | B2 | 12/2002 | Manzi |
| 6,543,157 | B2 | 4/2003 | Pan |
| 6,560,898 | B2 | 5/2003 | Borsoi et al. |
| 6,606,803 | B1 | 8/2003 | Ritter et al. |
| 6,606,804 | B2 | 8/2003 | Kaneko et al. |
| 6,637,130 | B2 | 10/2003 | Urie et al. |
| 6,701,644 | B2 | 3/2004 | Oorei et al. |
| 6,732,455 | B2 | 5/2004 | Bordin et al. |
| 6,772,540 | B2 | 8/2004 | Delgorgue et al. |
| 6,792,702 | B2 | 9/2004 | Borsoi et al. |
| 6,796,056 | B2 | 9/2004 | Swigart |
| 6,860,035 | B2 | 3/2005 | Girard |
| 6,877,256 | B2 | 4/2005 | Martin et al. |
| 6,877,257 | B2 | 4/2005 | Delgorgue et al. |
| 6,935,054 | B2 | 8/2005 | Hall et al. |
| 6,952,891 | B2 | 10/2005 | Hirayama |
| 6,993,859 | B2 | 2/2006 | Martin et al. |
| 7,010,823 | B2 | 3/2006 | Baek |
| 7,013,583 | B2 | 3/2006 | Greene et al. |
| 7,082,701 | B2 | 8/2006 | Dalgaard et al. |
| 7,086,181 | B2 | 8/2006 | Farys |
| 7,103,993 | B2 | 9/2006 | Sakai |
| 7,134,224 | B2 | 11/2006 | Elkington et al. |
| 7,159,340 | B2 | 1/2007 | Borsoi |
| 7,219,444 | B2 | 5/2007 | Hall |
| 7,243,444 | B2 | 7/2007 | Selner |
| 7,281,341 | B2 | 10/2007 | Reagan et al. |
| 7,293,373 | B2 | 11/2007 | Reagan et al. |
| 7,377,058 | B2 | 5/2008 | Elkington et al. |
| 7,386,947 | B2 | 6/2008 | Martin et al. |
| 7,392,990 | B2 | 7/2008 | Bussiere |
| 7,401,423 | B2 | 7/2008 | Reagan et al. |
| 7,546,698 | B2 | 6/2009 | Meschter |
| 7,574,818 | B2 | 8/2009 | Meschter |
| 8,122,616 | B2 | 2/2012 | Meschter et al. |
| 8,132,340 | B2 | 3/2012 | Meschter |
| 8,302,329 | B2 * | 11/2012 | Hurd et al. ..... 36/88 |
| 2001/0015023 | A1 | 8/2001 | Funk |
| 2001/0018805 | A1 | 9/2001 | Basso |
| 2002/0095750 | A1 | 7/2002 | Hammerslag |
| 2003/0079376 | A1 | 5/2003 | Oorei et al. |
| 2003/0154627 | A1 | 8/2003 | Hirayama |
| 2003/0172550 | A1 | 9/2003 | Balconi et al. |
| 2004/0244221 | A1 | 12/2004 | Hall et al. |
| 2005/0278980 | A1 | 12/2005 | Berend et al. |
| 2006/0174516 | A1 | 8/2006 | Peruzzo |
| 2006/0191164 | A1 | 8/2006 | Dinndorf et al. |
| 2007/0169377 | A1 | 7/2007 | Neiley |
| 2007/0169378 | A1 | 7/2007 | Sodeberg et al. |
| 2007/0271821 | A1 | 11/2007 | Meschter |
| 2008/0022554 | A1 | 1/2008 | Meschter et al. |
| 2008/0028641 | A1 | 2/2008 | Messmer |
| 2008/0168685 | A1 | 7/2008 | Kim et al. |
| 2008/0235995 | A1 | 10/2008 | Reagan et al. |
| 2008/0276489 | A1 | 11/2008 | Meschter |
| 2009/0077831 | A1 | 3/2009 | Mazzarolo |
| 2009/0100717 | A1 | 4/2009 | Cabanis |
| 2009/0133287 | A1 | 5/2009 | Meschter |
| 2009/0300947 | A1 | 12/2009 | Babolat |
| 2010/0037483 | A1 | 2/2010 | Meschter et al. |
| 2010/0043253 | A1 | 2/2010 | Dojan et al. |
| 2010/0175276 | A1 | 7/2010 | Dojan et al. |
| 2010/0251491 | A1 | 10/2010 | Dojan et al. |
| 2011/0041359 | A1 | 2/2011 | Dojan et al. |

FOREIGN PATENT DOCUMENTS

| | | |
|---|---|---|
| DE | 3900777 | 7/1990 |
| DE | 4129270 | 3/1993 |
| EP | 99504 | 2/1984 |
| EP | 132744 | 2/1985 |
| EP | 0585593 | 3/1994 |
| EP | 0623295 | 11/1994 |
| EP | 0748596 | 12/1996 |
| EP | 0842619 | 5/1998 |
| EP | 948910 | 10/1999 |
| EP | 0948910 | 10/1999 |
| EP | 995363 | 4/2000 |
| EP | 1013185 | 6/2000 |

(56) References Cited

FOREIGN PATENT DOCUMENTS

| | | | |
|---|---|---|---|
| EP | 1110466 | | 6/2001 |
| EP | 1308104 | | 5/2003 |
| EP | 1308104 | A2 | 5/2003 |
| EP | 1457124 | | 9/2004 |
| EP | 1486131 | | 12/2004 |
| EP | 1495691 | | 1/2005 |
| EP | 1308104 | B1 | 7/2005 |
| EP | 1787539 | | 5/2007 |
| EP | 1882420 | | 5/2007 |
| FR | 2496423 | | 6/1982 |
| FR | 2534116 | | 4/1984 |
| FR | 2621462 | | 4/1989 |
| FR | 2754981 | | 4/1998 |
| FR | 2830418 | | 4/2003 |
| FR | 2834182 | | 7/2003 |
| FR | 2844683 | | 3/2004 |
| JP | 1080303 | | 9/1987 |
| JP | 1148201 | | 10/1988 |
| JP | 2180201 | | 11/1989 |
| JP | 8010002 | | 6/1994 |
| JP | 2007136185 | | 6/2007 |
| JP | 2008029826 | | 2/2008 |
| NL | 1029423 | | 10/2006 |
| WO | 9004933 | | 5/1990 |
| WO | 9408478 | | 4/1994 |
| WO | 02076254 | | 10/2002 |
| WO | 2007046160 | | 4/2007 |

* cited by examiner

FOOTWEAR WITH COUNTER-SUPPLEMENTING STRAP

CROSS-REFERENCE TO RELATED APPLICATION

This application is a continuation of and claims priority to U.S. patent application Ser. No. 12/621,128 (now U.S. Pat. No. 8,302,329), titled "Footwear with Counter-Supplementing Strap" and filed Nov. 18, 2009. U.S. patent application Ser. No. 12/621,128, in its entirety, is incorporated by reference herein.

BACKGROUND

The design of footwear is sometimes driven by conflicting requirements. Two examples of such requirements are support and comfort. For many types of footwear, it is desirable for a shoe to support the wearer's foot during certain types of high-stress and/or fast moving activities. Providing such support may involve strengthening portions of a shoe by making those portions thicker or larger and/or by using stiffer materials. Such measures can often reduce comfort, however. If a shoe structure is made stiffer and/or larger, it is less able to conform to the wearer's foot and may become uncomfortable during certain movements.

These concerns often arise in the design of athletic shoes. In basketball and various other sports, a player may frequently change direction of travel by "cutting" quickly to one side. For example, a forward-moving basketball player may cut to the left by pushing hard on his right foot. As he does so, his right shoe may provide less support. A stiffer and/or enlarged counter would be desirable to support the foot and help prevent excessive heel motion when the player is cutting, thereby helping to stabilize the footbed. However, a counter that does not conform to the heel during such motion could become uncomfortable.

SUMMARY

This Summary is provided to introduce a selection of concepts in a simplified form that are further described below in the Detailed Description. This Summary is not intended to identify key features or essential features of the invention.

In some embodiments, an article of footwear includes a rear strap that supplements a lateral side counter during certain movements. A heel cup formed from a flexible material is located under a heel region of an upper portion of the article. Lateral and medial counters extend upward from the heel cup on the lateral and medial sides. The medial counter may have a height less than that of the lateral counter. A rear edge of the heel cup is lower than the lateral and medial counters. The rear strap extends upward, around the lateral counter and around the Achilles tendon of the wearer, and is secured to a location on the upper that is forward of the wearer's ankle. During cutting movements in which the article is worn on the outside foot, tilting of the wearer foot and ankle toward the medial side pulls the strap and causes the lateral counter to conform to and support the wearer heel.

BRIEF DESCRIPTION OF THE DRAWINGS

Some embodiments are illustrated by way of example, and not by way of limitation, in the figures of the accompanying drawings and in which like reference numerals refer to similar elements.

DETAILED DESCRIPTION

Definitions

To assist and clarify subsequent description of various embodiments, various terms are defined herein. Unless otherwise indicated, the following definitions apply throughout this specification (including the claims). The "interior" of a shoe refers to the space that is occupied by a wearer's foot when the shoe is worn. An "inner" side or face of a shoe element refers to a side or face of that element that is (or will be) oriented toward the shoe interior in a completed shoe when the shoe is fastened to a wearer's foot. An "outer" side or face of an element refers to a side or face that is (or will be) oriented away from the shoe interior in the completed shoe when the shoe is fastened to a wearer's foot. In some cases, an inner side/face of an element may have other elements between it and the interior in the completed shoe. Similarly, an outer side/face of an element may have other elements between it and the space external to the completed shoe.

Certain regions of a shoe may also be described by reference to the anatomical structures of a human foot wearing a shoe that is properly sized for that foot. One or more of the below-defined regions may overlap. A "forefoot" region will generally cover the metatarsal and phalangeal bones of the wearer's foot and will extend beyond the wearer's toes to the frontmost portion of the shoe. A "midfoot" region will generally cover the cuboid, navicular, medial cuneiform, intermediate cuneiform and lateral cuneiform bones of the wearer's foot. A "hindfoot" region of an upper extends from the midfoot region to the rearmost portion of the shoe and covers the wearer heel. The hindfoot region covers the sides of the calcaneous bone of a wearer and may, depending on a particular shoe configuration, cover some or all of the wearer's talus bone (ankle).

As used herein, "coupled" includes two elements that are attached directly or by one or more intermediate elements.

Shoe with Counter Supplementing Strap

Figure 1A:
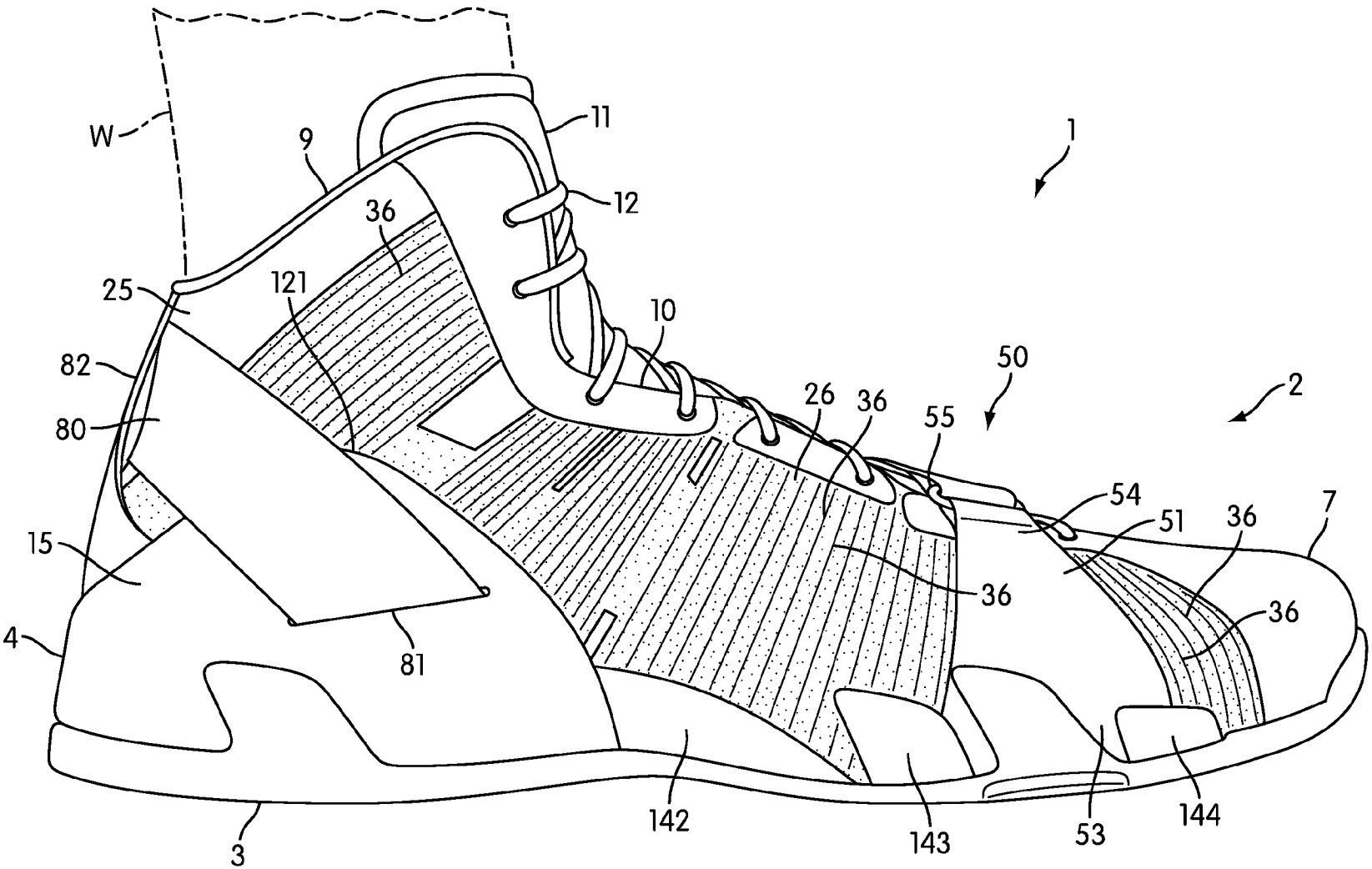
FIG. 1A is a lateral side view of a shoe according to some embodiments.
Figure 1B:
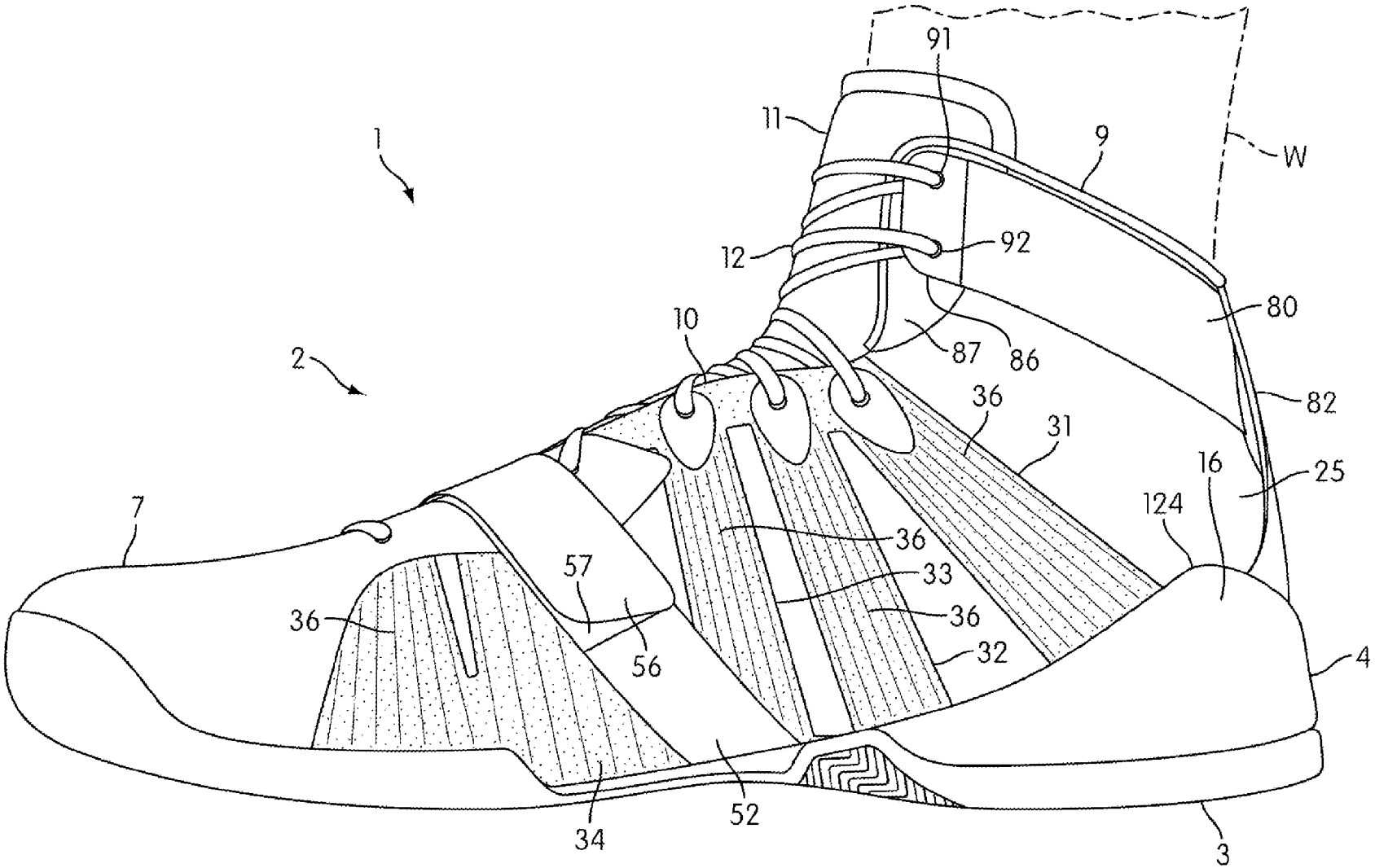
FIG. 1B is a medial side view of the shoe of FIG. 1A.
Figure 1C:
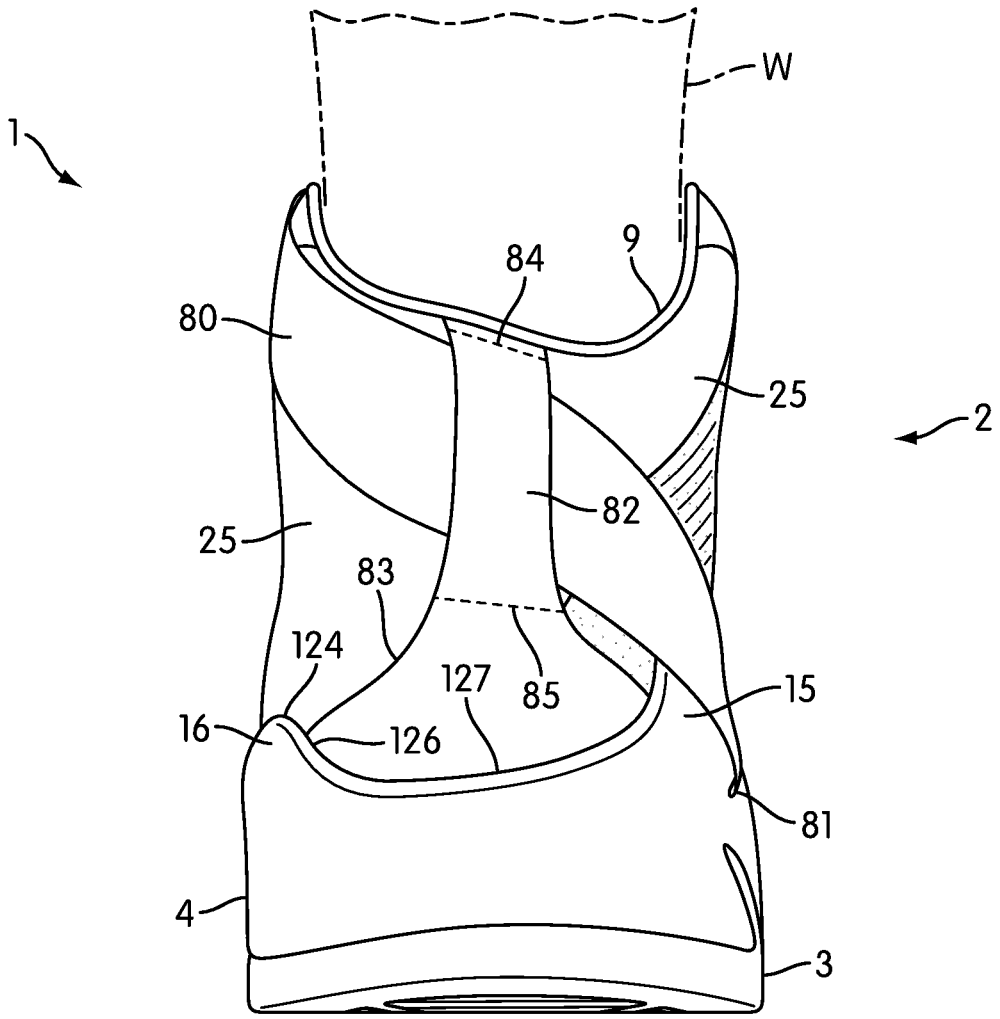
FIG. 1C is a rear view of the shoe of FIG. 1A.
Figure 1D:
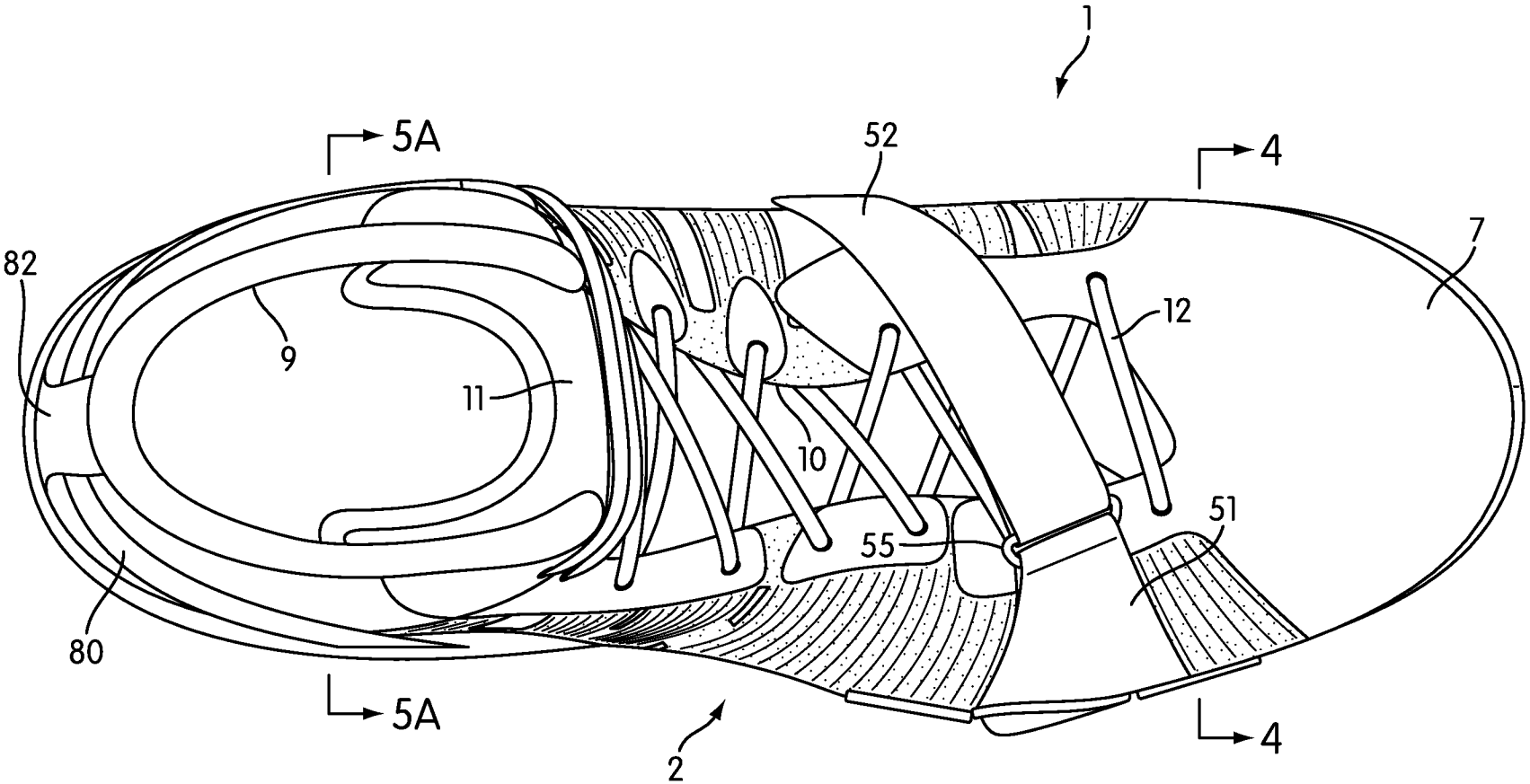
FIG. 1D is a top view of the shoe of FIG. 1A.
Figure 1E:
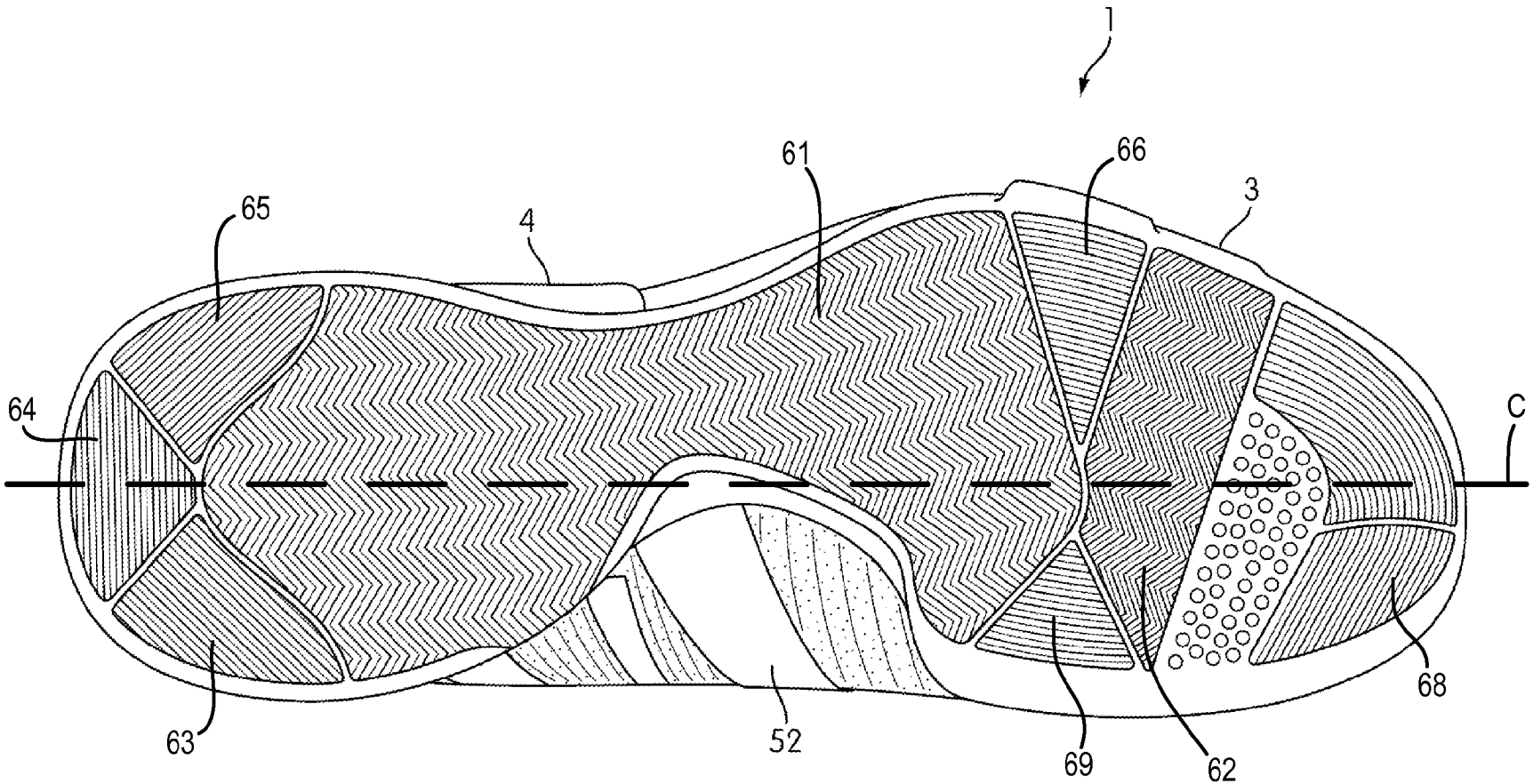
FIG. 1E is a bottom view of the shoe of FIG. 1A.

FIG. 1A is a lateral side view of a basketball shoe 1 according to some embodiments. FIG. 1B is a medial side view. Shoe 1 is for the right foot, with a left foot shoe (not shown) being a mirror image of shoe 1. FIG. 1C is a rear view of shoe 1. FIGS. 1D and 1E are top and bottom views, respectively, of shoe 1. Shoe 1 includes an upper 2 that is bonded to an outsole 3 and to a heel cup 4, with heel cup 4 also being bonded to outsole 3. As described in more detail below in connection with FIG. 2, a reinforcing plate 5 is interposed between upper 2 and heel cup 4 (in the rear of shoe 1) and outsole 3 (in the front of shoe 1).

Upper 2 includes an opening that includes a foot receiving opening 9 and a tongue opening 10. Tongue 11 generally covers tongue opening 10, the sides of which are pulled together by shoelace 12. When worn on the foot of a wearer W for whom shoe 1 is properly fitted, the ankle of wearer W is covered by the portion of upper 2 below foot receiving opening 9. As described in more detail below, heel cup 4 is a one piece element that extends under upper 2 in a region that corresponds to the heel of wearer W. Heel cup 4 further includes a lateral counter 15 and a medial counter 16 that each extends upward toward foot receiving opening 9. The top 121 of lateral counter 15 is higher than the top 124 of medial counter 16, and the region 127 of heel cup 4 between counters 15 and 16 (FIG. 1C) is only slightly higher than the bottom edge of the wearer W heel.

Upper 2 includes a main panel 25 that extends over substantially all of upper 2 and that is formed from a stretchable lightweight textile material such as nylon. Other materials that can be used for main panel 25 include but are not limited to polyester, spandex or a knit textile in which the weave is movable (relative to itself) along a bias direction. The front portion of main panel 25 may be covered with a synthetic leather toe cap 7. Bonded to the outer face of main panel 25 on the lateral side is a reinforcing panel 26. Similarly bonded to the outer face of main panel 25 on the medial side are reinforcing panels 31, 32, 33 and 34. So as to distinguish them from other portions of upper 2, reinforcing panels 26 and 31-34 are shown in the drawings with stippling.

Each of reinforcing panels 26 and 31-34 includes a series of tensile members 36. So as to avoid confusing the drawings with unnecessary detail, only selected tensile members 36 are specifically identified with lead lines and reference numbers. However, the presence and locations of other tensile members 36 are readily apparent in the drawings. Tensile members 36 are formed from strands that are generally non-stretchable (i.e., experience no appreciable elongation) at loads experienced during athletic activities. Example materials for such strands include liquid crystal polymer (LCP) fibers of aromatic polyester such as are sold under the trade name VECTRAN by Kuraray America, Inc. Other example strand materials include but are not limited to nylon and high-tensile polyester. In some embodiments, reinforcing panels 26 and 31-34 are created by first embroidering tensile members 36 into textile substrate panels using techniques such as are described in one or more of the following: U.S. Pat. No. 7,574,818; U.S. Pat. No. 7,546,698; U.S. Patent Application Publication No. 2007/0271821; U.S. Patent Application Publication No. 2008/0022554; U.S. patent application Ser. No. 12/180,235 (titled "Composite Element with a Polymer Connecting Layer" and filed Jul. 25, 2008); U.S. Patent Application Publication No. 2008/0276489; U.S. Patent Application Publication No. 2009/0133287; U.S. patent application Ser. No. 12/419,987 (titled "Footwear Incorporating Crossed Tensile Strand Elements" and filed Apr. 7, 2009); U.S. patent application Ser. No. 12/419,985 (titled "Method for Molding Tensile Strand Elements" and filed Apr. 7, 2009); U.S. patent application Ser. No. 12/505,740 (titled "Material Elements Incorporating Tensile Strands" and filed Jul. 20, 2009); U.S. patent application Ser. No. 12/546,017 (titled "Article of Footwear Incorporating a Tensile Element" and filed Aug. 24, 2009); U.S. patent application Ser. No. 12/546,019 (titled "Article of Footwear Having an Upper Incorporating a Tensile Strand with a Cover Layer" and filed Aug. 24, 2009); and U.S. patent application Ser. No. 12/546,022 (titled "Article of Footwear Incorporating Tensile Strands and Securing Strands" and filed Aug. 24, 2009). All of said U.S. patents and patent applications are incorporated by reference herein in their entirety. In the event of any inconsistency between a definition (or usage) of a term within this specification (prior to incorporation of said documents) and a definition (or usage) of that term in one of said documents incorporated by reference, the definition (or usage) of that term within this specification (prior to incorporation of said documents) shall control. Other techniques, materials and/or structures described in one or more of said incorporated documents may also be included in footwear according to some embodiments of the present invention.

Returning to FIGS. 1A-1E, the embroidered substrate panels are bonded to main panel 25 using a layer of hot melt bonding material interposed between inner faces of the embroidered substrate panels and an outer face of main panel 25, with thermoplastic polyurethane (TPU) panels bonded to the outer faces of the embroidered substrate panels (e.g., using an additional layer of hot melt bonding material). In some embodiments, reinforcing panels 26 and 31-34 can be formed without a substrate panel by embroidering tensile members 36 directly into a layer of hot melt bonding material, and then using that embroidered hot melt bonding material layer to bond inner faces of TPU panels to an outer face of main panel 25.

Forward reinforcing strap 50 includes a lateral strap 51 and a medial strap 52. Lateral strap 51 is attached to shoe 1 on the lateral side in a region that generally corresponds to the distal end of a wearer's fifth metatarsal and fifth proximal phalange (FIG. 1A). Lateral strap 51 fans out so as to be broader in a lower portion 53 than in a higher portion 54. Lateral strap 51 has a terminal end (not shown in FIG. 1A) that is fixed between upper 2 and outsole 3. The terminal end of strap 51 can be fixed by bonding to the underside of upper 2 and/or to an upper surface of outsole 3. As used herein, "bonding" includes bonding through use of glue or other adhesives, as well as bonding through the melting and subsequent solidification of a bonding material (e.g., TPU), which bonding material can be a substituent element of a bonded component or a separate material added to facilitate bonding. A portion of strap 51 could also be bonded and/or mechanically attached (e.g., using stitches) to the lateral side of upper 2. A free end of strap 51 has a metal loop 55. Medial strap 52 is fixed to shoe 1 so as to extend over the medial side in a region that generally corresponds to a wearer's medial cuneiform bone (FIGS. 1B and 1E). Medial strap 52 has a terminal end (not shown in FIGS. 1B and 1E) that is fixed between upper 2 and outsole 3. The terminal end of strap 52 can be fixed by bonding to the underside of upper 2 and/or to an upper surface of outsole 3. A portion of strap 52 could also be bonded and/or mechanically attached (e.g., using stitches) to the medial side of upper 2. A free end 56 of medial strap 52 can be passed through metal loop 55 and then pulled back over medial strap 52 and secured in place with hook and loop fastening material. Specifically, a panel 57 of loop material is attached to the outside face of strap 52 (in the portion not pulled through metal loop 55 when fastening strap 50) and a panel of hook material is attached to the inside face of strap 52 near free end 56.

In other embodiments, a forward reinforcing strap may connect medial and lateral portions in another manner. For example, a lateral portion of a forward reinforcing strap could have an exposed terminal end having lace eyelets on the lateral side of the tongue opening, with the medial portion of a forward reinforcing strap having an exposed terminal end having lace eyelets on the medial side of the tongue opening. The medial and lateral portions of the strap could then be coupled by strands of the lace that are interlaced in those eyelet holes. In this manner, a separate metal loop or other buckling system can be avoided.

Lateral strap 51 and medial strap 52 are each formed from materials that are generally non-stretchable (i.e., experience no appreciable elongation) under loads that would be imposed on forward reinforcing strap 50 during side-to-side cutting movements typical of basketball and other types of athletic activities. Examples of such materials include, but are not limited to, TPU reinforced with VECTRAN or nylon (polyamide polymer) fibers.

Counter-supplementing strap 80 extends around lateral counter 15 and around the rear of shoe 1, and is securable on the medial side of upper 2 near the top of tongue opening 10. Referring first to FIG. 1A, strap 80 extends from a slot 81 and continues upward across the outside surface of lateral counter 15. Although not seen in FIG. 1A, a terminal end of strap 80 is secured under the wearer's heel by bonding the terminal portion between upper 2 and heel cup 4. The terminal end of strap 80 can be fixed by bonding to the underside of upper 2 and/or using a mechanical attachment mechanism such as stitching. As seen in FIG. 1C, strap 80 wraps upward and around the rear of shoe 1 over the Achilles tendon of wearer W. Strap 80 passes through a space between an element 82 of foxing panel 83 and main panel 25. Strap 80 can move up and down slightly between an upper stitch 84 and a lower stitch 85, but is otherwise restrained by element 82. As seen in FIG. 1B, strap 80 extends across the medial hindfoot portion of upper 1 and generally lies over the ankle of wearer W. A free end 86 of strap 80 is securable to the medial side of upper 1 near the top of tongue opening 10 with hook and loop fastening material. Specifically, a panel of hook material (not shown) on the inside of strap 80 near free end 86 contacts loop material of panel 87 to hold strap free end 86 forward of and at or above the height of the wearer W ankle. Eyelet holes 91 and 92 in free end 86 receive lace 12. In this manner, strap 80 can be tightened around a wearer's foot and secured in place when lace 12 is tightened and tied. In at least some embodiments, hook material on the free end of the counter-supplementing strap and corresponding loop material on the upper serve merely to keep the strap loosely in place while the shoe is being donned or removed. Once the shoe has been donned, the counter-supplementing strap is tightened by the pulling action of the shoes lace. Accordingly, such hook and loop material could be omitted. As another alternative, a separate panel of material could be attached on the medial side, near the desired location of the free end, to act as a "belt loop" for the strap.

As can be appreciated from FIGS. 1A-1C and the above description, much of strap 80 is not fixed to upper 2. Subject to restraints imposed by the securing of its terminal end between upper 2 and heel cup 4, the securing of free end 86, and stitching 84 and 85, strap 80 is able to move relative to other portions of upper 2. In particular, strap 80 floats between stitching 84 and 85 and relative to the sides of upper 2 as the wearer's foot moves and shoe 1 deforms. Similarly, strap 80 is not bonded or otherwise attached to counter 15. Except for constraints imposed by the boundaries of slot 81 through which strap 80 passes (FIG. 1A), strap 80 floats freely relative to counter 15. In other words, the inner surface of strap 80 is able to slide across the outer surface of counter 81 above slot 81. Similarly, the outer surface of strap 80 is able to slide across the inner surface of counter 15 below slot 81. This floating of strap 80 relative to other elements of shoe 1 permits counter 15, upper 2 and other elements of shoe 1 to more readily conform to the shape of a wearer foot during certain cutting movements described below.

Strap 80 is also formed from one or more materials that are generally non-stretchable under loads that would be imposed during side-to-side cutting movements typical of basketball and other types of athletic activities. Examples of such materials include, but are not limited to, TPU reinforced with nylon or VECTRAN fibers.

Figure 2:
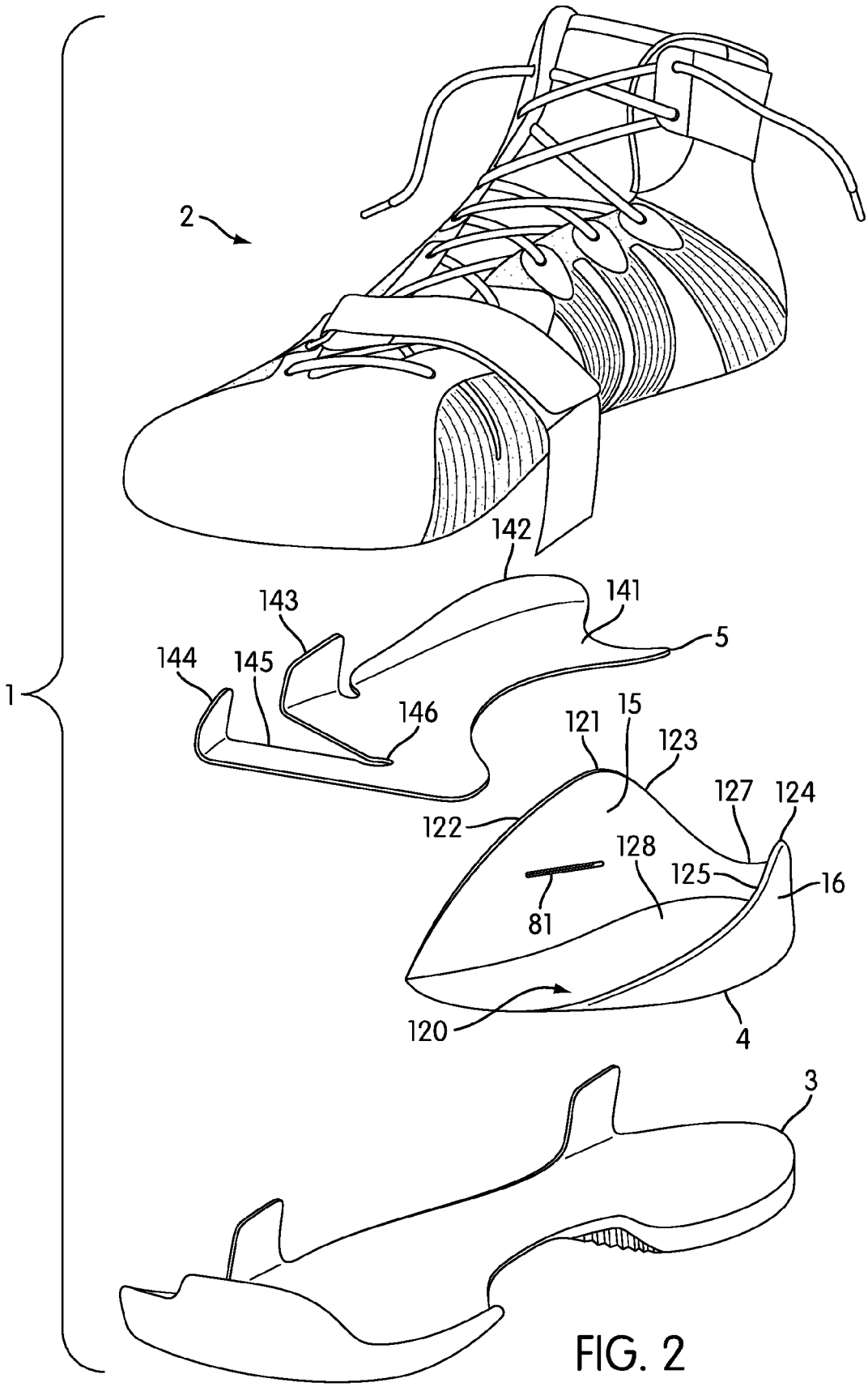
FIG. 2 is a partially exploded view, from a medial front perspective, of the shoe of FIG. 1A.

FIG. 2 is a partially exploded view of shoe 1 from a medial front perspective. Outsole 3 is the lowermost element of shoe 1. Outsole 3 is molded from one or more materials having sufficient durability and friction coefficient so that the ground engaging portion of outsole 3 (seen in FIG. 1E) can withstand repeated contact with the ground but still permit effective traction. Suitable materials for outsole 3 include but are not limited to natural or artificial rubber (e.g., thermoplastic rubber (TPR)). As seen in FIG. 1E, outsole 3 according to at least some embodiments includes a number of regions in which the tread pattern varies. A large portion of the tread in outsole 3 has a herringbone tread pattern (regions 61 and 62). Other portions have a straight pattern (regions 63, 64, 65, 66, 68 and 69). Regions 63, 64 and 65 are located in areas that lie under the outside of edges of the heel of wearer W. Region 66 is near the lateral outside edge and approximately under a distal end of the fifth metatarsal of the wearer W. Region 69 is located near the medial outside edge and approximately under a distal end of a wearer first metatarsal. Region 68 is located at the lateral front edge and approximately under a first distal phalange of wearer W.

Other things being constant (e.g., tread material, tread area, tread line size, etc.), a straight tread pattern typically provides superior traction relative to a herringbone pattern along certain directions. Specifically, the traction in directions perpendicular to the treads of a straight pattern is generally greater than the traction available from a herringbone pattern. In directions parallel to straight treads, however, less traction is provided than is provided by a herringbone pattern. The straight treads of regions 63, 64 and 65 are oriented to be perpendicular to the directions of forces typically imposed when a wearer's heel comes into contact with the ground during many types of movements. In some embodiments, the treads of region 64 are oriented approximately 90° relative to the longitudinal centerline C of shoe 1, with the treads of region 63 and of region 65 forming angles from centerline C (opening toward the toe of shoe 1) of approximately 45°. The straight treads of regions 66 and 69 are oriented so as to be generally perpendicular to the directions of forces imposed during cutting movements described below. In some embodiments, the tread lines of region 66 are oriented to form angles from centerline C (opening toward the heel of shoe 1) of approximately 15°, with the tread lines of region 69 oriented to form angles from centerline C (opening toward the toe of shoe 1) of approximately 10°. The straight tread lines of region 68 are oriented so as to be generally perpendicular to the directions of forces imposed by a wearer's toe when pushing off during a run or a forward jump. In some embodiments, the tread lines of region 68 form angles from centerline C (opening toward the heel of shoe 1) of approximately 60°.

Returning to FIG. 2, heel cup 4 is located above outsole 3. In some embodiments, heel cup 4 is flexible and at least partially compressible during some forces imposed during normal wear. In other embodiments, heel cup 4 is flexible but generally not compressible under forces imposed during normal wear. The underside of heel cup 4 is bonded to the portion of outsole 3 that lies under the heel of wearer W. Heel cup 4 includes a base 120, lateral counter 15 and medial counter 16. In at least some embodiments where compressibility is desired, heel cup 4 is molded as a single piece from compressed ethylene vinyl acetate (EVA) foam, commonly known as "Phylon." Other materials that could be used to form heel cup 4 include polyurethanes, TPU and nylon. In some embodiments in which heel cup 4 is formed from Phylon, the thickness of base 120 may range from 8 to 12 millimeters in the thicker portions of base 120 (toward the rear), with the thickness of base 120 feathering to a thinner cross section toward the front. The thickness of lateral side counter 15 may range from 3 to 6 millimeters, and the thickness of medial side counter 16 may range from 3 to 6 millimeters.

Lateral counter 15 includes a top portion 121, a forward edge 122 and a rear edge 123, with edges 122 and 123 extending downward from top portion 121 toward base 120. Similarly, medial counter 16 includes a top portion 124 and forward and rear edges 125 and 126 (see FIG. 1C) that extend downward from top portion 124 toward base 120. The rear edge 127 of heel cup 4 between lateral counter 15 and medial counter 16 is only slightly higher than the inner surface 128 of base 120. Although each of edges 122, 123, 125 and 126 is straight, this need not be the case. Similarly, top portions 121 and 124 could have different shapes (e.g., broader and/or scalloped). As also seen in FIG. 2, and by comparing FIGS. 1A and 1B, medial counter 16 is also positioned closer than lateral counter 15 to the rear of shoe 1.

In at least some embodiments, and as shown in FIGS. 1A-2, lateral counter 15 extends upward from base 120 more than medial counter 16. In some embodiments, lateral and medial counters may be closer in height, while in other embodiments the height of a lateral counter may be an even larger percentage of the medial counter height. A larger counter height is desirable to provide additional support. However, excessive height can cause discomfort if the top portion of a counter contacts the underside of a wearer ankle when the wearer foot and ankle tilts laterally or medially during athletic activities. In at least some embodiments, the heights of lateral counter 15 and medial counter 16 are determined by estimating the maximum amount of foot and ankle tilt that could be expected during a cutting action and sizing the counters so as to be just under a height that might contact the lower sides of a wearer ankle. In at least some such embodiments, the maximum height of the medial side counter does not exceed 75% of the maximum height of the lateral side counter.

Reinforcing plate 5 is located between upper 2 and the other elements shown in FIG. 2. In other embodiments, reinforcing plate 5 may be located between the outer side of an inner midsole 160 (discussed below) and the inner side of main panel 25 of upper 2. In the embodiment of FIG. 2, a rear portion 141 of plate 5 is located between the inner surface 128 of heel cup 4 and a corresponding lower outer surface of upper 2. The remainder of plate 5 is located between lower and lateral outer surfaces of upper 2 and the inner surface of outsole 3. The lateral sides of plate 5 include wings 142, 143 and 144. Wings 142-144 are substantially rigid relative to adjacent horizontal portions of plate 5 to which the wings are connected. In this manner, wings 142-144 correspond to the lateral edge of the wearer W foot and provide additional support during cutting movements. Wings 143 and 144 (and to a lesser extent, wing 142) correspond to wearer foot anatomy locations along lines of force during various cutting movements. Wing 142 also increases the stiffness of plate 5 in the heel region of shoe 1. Plate 5 can be formed from materials that include (but are not limited to) composites of 50% carbon fiber and 50% glass fiber bound in epoxy or polyester resin, or bound in other types of polymer (e.g., nylon or TPU). In at least some embodiments, the center of wing 143 is displaced from the rearmost portion of shoe 1, along the longitudinal centerline C (see FIG. 1E), by a distance that is approximately 60% of the heel-to-toe length of shoe 1. In some such embodiments, the center of open region 145 is displaced from the rearmost portion of shoe 1 along the longitudinal centerline C by a distance that is approximately 70% of the heel-to-toe length of shoe 1, and the center of wing 144 is displaced from the rearmost portion of shoe 1 along the longitudinal centerline C by a distance that is approximately 80% of the heel-to-toe length of shoe 1. Plate 5 includes an open region 145 and a rounded corner region 146. Corner region 146 is generally positioned under the ball of the foot of wearer W. Open region 145 allows plate 5 to afford some flexibility in the forefoot region.

Figure 3A:
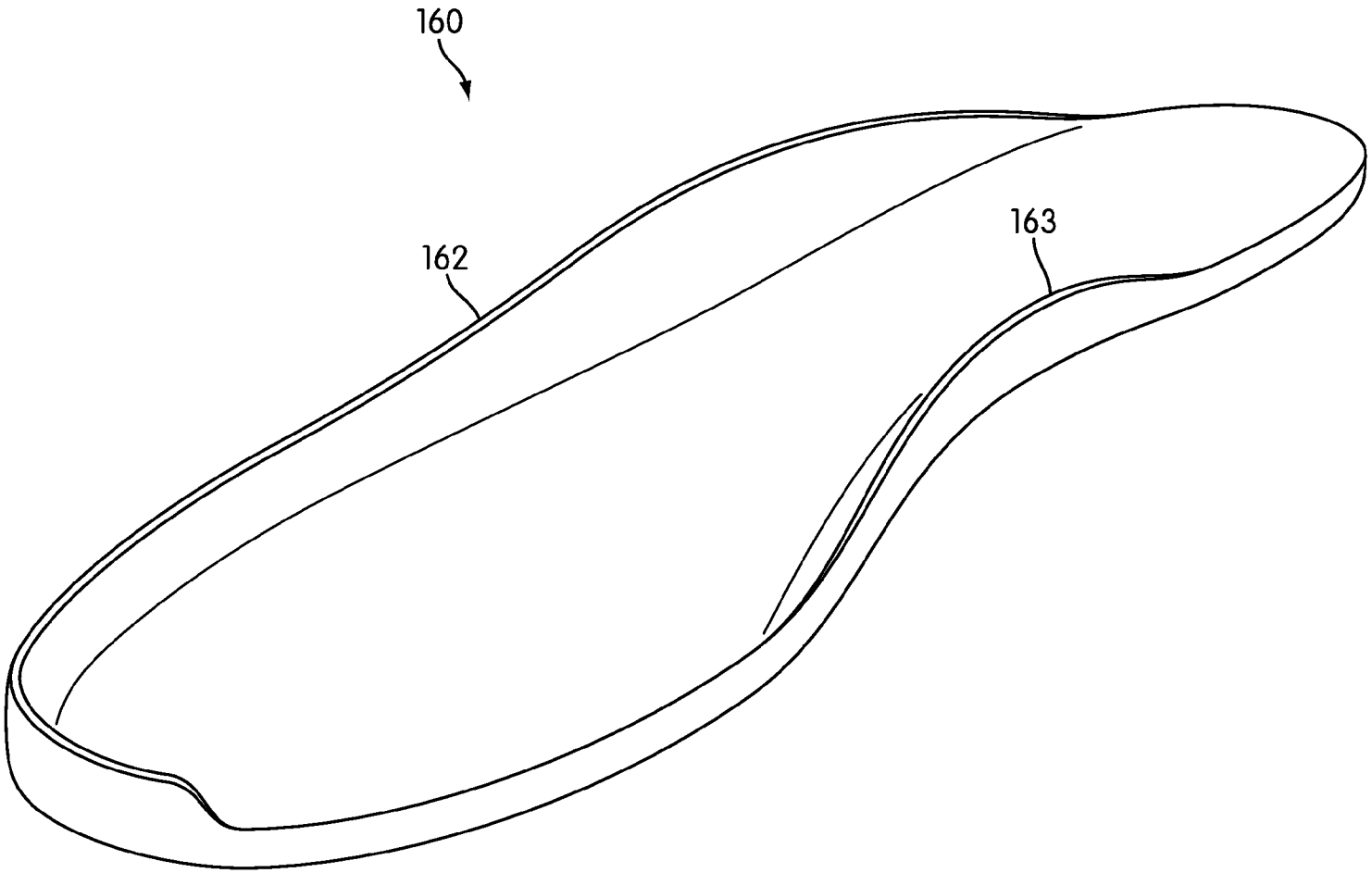
FIG. 3A is a front medial perspective view of a midsole of the shoe of FIG. 1A.
Figure 3B:
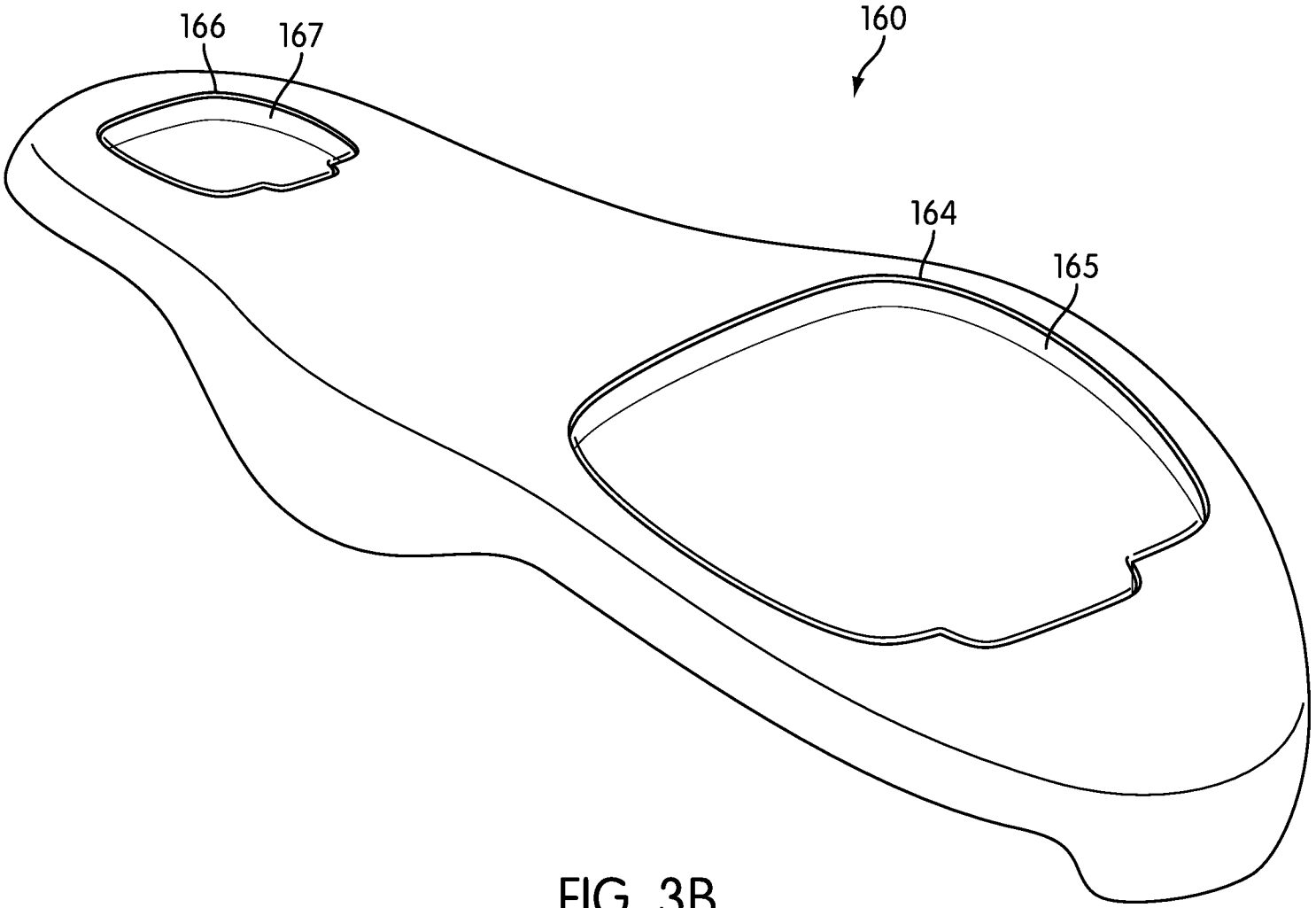
FIG. 3B is a lateral perspective view of the underside of the midsole of the shoe of FIG. 1A.

FIG. 3A is a front medial perspective view of a midsole 160 removed from upper 2. Midsole 160 is located on the inside of upper 2 and is bonded to the inner lower surface of textile main panel 25. As seen in FIG. 3A, midsole 160 is "cup" midsole having a rim 162 that extends from the toe region and along substantially all of the lateral side. Midsole 160 further has an arch support portion 163 on the medial side. Midsole 160 may be formed from Phylon, foamed polyurethane or other compressible material. FIG. 3B is a lateral perspective view of the underside of midsole 160. A first pocket 164 formed in the forefoot region of midsole 160 holds a first cushioning pad 165. A second pocket 166 formed in the heel region of midsole 160 holds a second cushioning pad 167. Cushioning pads 165 and 167 can be elastomeric chambers filled with a fluid (gas or liquid). Examples of fluid-filled elastomeric chambers are provided in commonly-owned U.S. Pat. No. 6,796,056.

Placement of midsole 160 inside of upper 2 helps to moderate pressure on the foot of wearer W that might be imposed by forward strap 50 and/or by counter-supplementing strap 80. When strap 80 is pulled tight against the lateral side of the wearer W foot during a cutting motion, midsole 160 helps to distribute the resulting force over a larger portion of the foot and thus reduce the pressure from the strap. Similar pressure moderation is provided in the regions surrounding forward strap 50. Lateral side rim 162 also provides additional cushioning and support during certain motions. When the lateral edge of the wearer W foot pushes against the lateral side of shoe 1 during a cut, for example, rim 162 helps to stabilize the foot within shoe 1.

Figure 4:
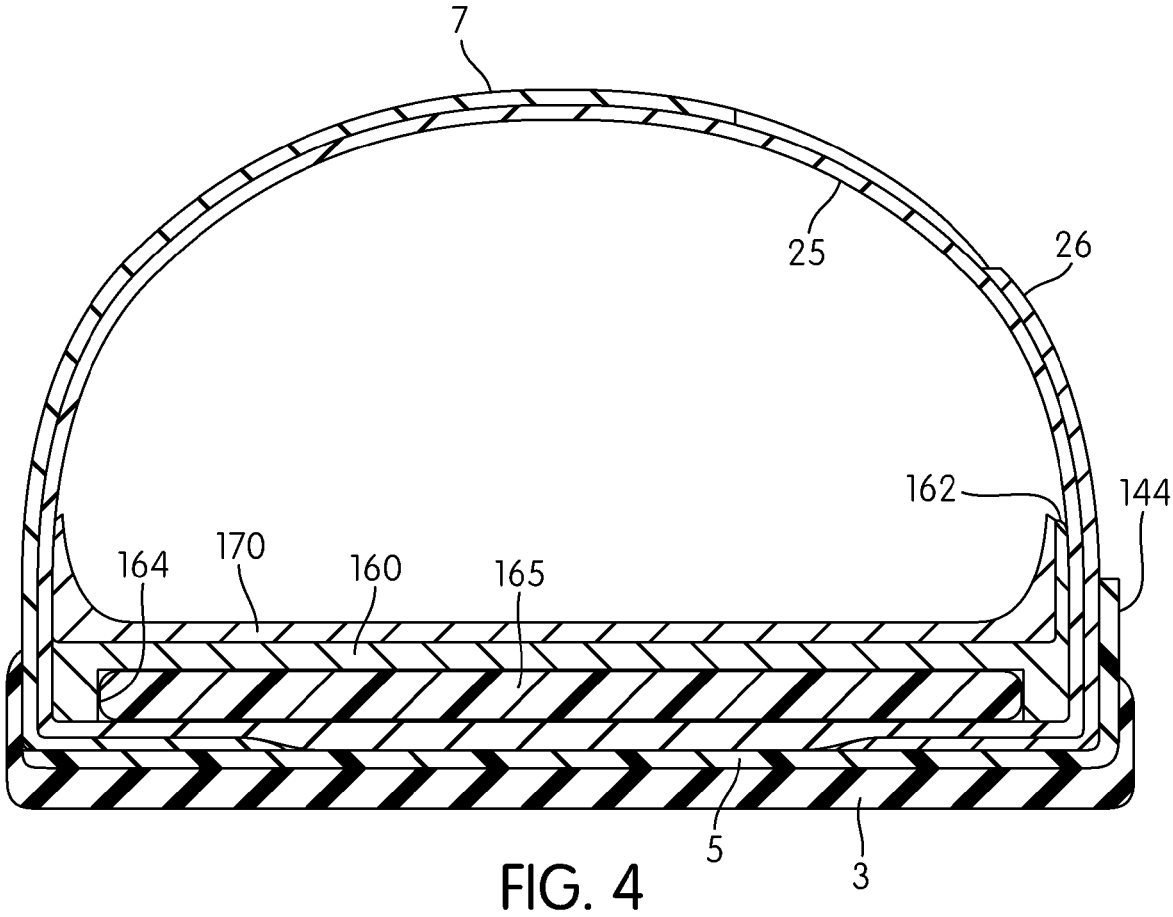
FIG. 4 is a cross-sectional view taken from the location shown in FIG. 1D.

FIG. 4 is an enlarged cross-sectional view of upper 2 taken from the location shown in FIG. 1D. Midsole 160 and pad 165 are bonded to the inside lower surface of main panel 25. However, the sides of midsole 160 are not bonded to the inner side walls of main panel 25. In other words, only the bottom portions of midsole 160 (facing toward the bottom of the page in FIG. 4) are bonded to main panel 25. A removable sock liner 170 rests over the top surface of midsole 160.

In at least some embodiments, shoe 1 is assembled by placing midsole 160 (with previously installed pads 165 and 167) on a last so that the inner face of midsole 160 is facing the last and the outer face of midsole 160 is facing upward. Other portions of upper 2 (e.g., main panel 25, reinforcing panels 26 and 31-34, toe cap 7, foxing panel 83, tongue 11) are separately assembled and then lasted onto and bonded to midsole 160. In some embodiments, main panel 25 completely surrounds the outer face of midsole 160 and is stitched down the center. Some or all of reinforcing panels 26 and 31-34 may also extend all the way across the outer face of midsole 160 (e.g., terminal ends of panels 31-34 may join to locations on a terminal end of panel 26). In other embodiments, portions of midsole 160 that will be covered by outsole 3 are not covered by main panel 25 or by a reinforcing panel. After the other portions of upper 2 are lasted over midsole 160, plate 5 is bonded to upper 2. Heel cup 4 is then bonded into place with the terminal end of strap 80 bonded between the outer face of reinforcing plate 5 and inner face 128 (FIG. 2) of heel cup 4. Outsole 3 is then bonded to the already assembled elements. Other types of Strobel and lasting constructions can be used.

As indicated above, features of shoe 1 offer several advantages during athletic maneuvers known as "cuts." When cutting to the left, an athlete pushes hard on the right foot to change a direction of forward motion (or to initiate motion) sharply to the athlete's left side. Similarly, an athlete cutting to the right pushes hard on the left foot to change a direction of movement (or to begin moving) sharply to the athlete's right. When cutting, more of the athlete's weight may be placed on the outside foot (i.e., the right foot in a left cut, the left foot in a right cut). Moreover, the outside foot and ankle often tilt significantly to the medial side. Because the outside foot then rests more on its medial edge, that foot tries to leverage out of the shoe. Parts of the shoe may no longer adequately support or contain parts of the leveraging foot, resulting in a loss of foot stability.

Because strap 80 floats relative to counter 15 and other portions of shoe 1, upper 2 can dynamically adapt to the forces imposed when a wearer engages in a cutting maneuver. When a wearer foot leans to the medial side, non-stretching strap 80 moves across the surface of counter 15 while remaining attached below the wearer's heel. As the wearer foot leans more to the medial side, the pulling force on strap 80 increases, thereby increasing the deformation of counter 15 so as to increase conformance of counter 15 to the wearer heel.

Figure 5B:
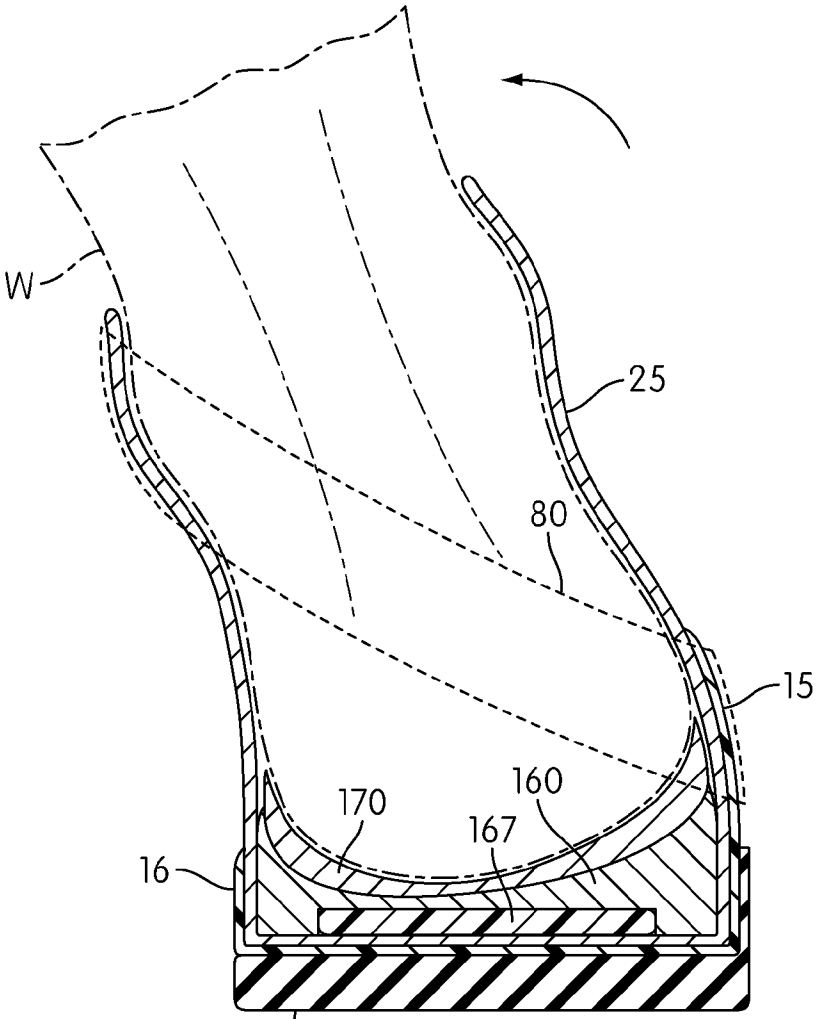
FIGS. 5A and 5B are partial cross-sectional views of the shoe of FIG. 1A from the location shown in FIG. 1D.
Figure 5A:
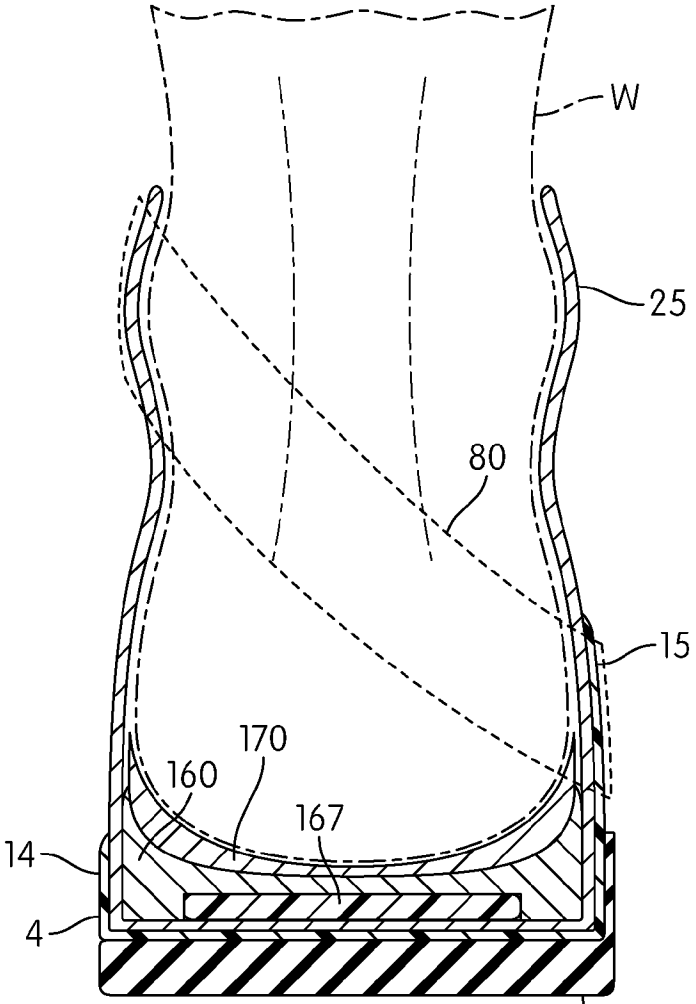

FIGS. 5A and 5B are partially schematic cross-sectional views of shoe 1 from the location shown in FIG. 1D, and with the foot and lower leg of wearer W shown in uneven broken lines. Strap 80 is shown in broken lines. In FIG. 5A, wearer W is standing straight and not moving to the left or the right. As shown in FIG. 5A, and as previously described in connection with FIG. 2, medial counter 16 has a height less than that of lateral counter 15. In the cross sectional views of FIGS. 5A and 5B, the top 124 of medial counter 16 is rearward of the cross-sectional plane.

In FIG. 5B, wearer W is cutting to the left. As previously indicated, shoe 1 is a right shoe, and is thus on the outside foot during a left cut. The below description of shoe 1 during a left cut will similarly apply to a left shoe during a right cut. As seen in FIG. 5B, the foot and ankle of wearer W tilt medially and the heel pushes laterally as wearer W pushes to the left. Tilting the foot medially pulls on strap 80, which in turn pulls lateral counter 15 toward the heel. Because strap 80 is able to float relative to upper 2 and counter 15 with minimal pulling on the surfaces of upper 2 and counter 15, much of the tension on strap 80 can be concentrated on deformation of counter 15 so as to support and conform to the wearer W heel. Although not shown in FIG. 5B, medial counter 16 is similarly pushed down by (and conforms to) the rear medial side of the heel. As also seen in FIG. 5B, the action of strap 80 causes heel cup 4 to remain conformed to the heel while outsole 3 remains substantially flat. This conformance of heel cup 4 limits movement of the heel within shoe 1 and helps to stabilize the wearer W foot. Because counters 15 and 16 readily conform to the heel, however, discomfort associated with certain conventional stiff counters can be avoided.

In at least some embodiments, and as shown in FIGS. 5A and 5B, sock liner 170 is curved upwards and around the inside of shoe 1 so as to further surround and contain the heel. This anatomical shaping of sock liner 170 to cup the heel helps contain the heel and increases comfort.

Although not shown in the drawings, the inside foot and ankle of wearer W may tilt laterally during a cut in the opposite direction. During a cut to the right, for example, shoe 1 (on the right foot of wearer W) will be on the inside foot. Lateral counter 15 will conform to the lateral side of the heel during such a movement based on the downward force of the heel and ankle onto lateral counter 15. Although a separate strap does not pull medial counter 16 into conformance with the medial side of the heel in the embodiment shown in FIGS. 1-5B, other embodiments may include a separate strap that is similar to strap 80, but which extends around counter 16 and the wearer's Achilles tendon and is secured (e.g., on the medial side at ankle level) so as to pull on that strap when the foot and ankle tilt laterally. As with strap 80, such a medial counter reinforcing strap could be non-stretching. A medial counter reinforcing strap could also float relative to counter 16 and upper 2 in the same manner that strap 80 floats relative to counter 15 and upper 2.

As previously indicated in connection with FIG. 2, the rear edge 127 of heel cup 4 is substantially lower than medial counter 16 and lateral counter 15. This creates a gap on the rear side of heel cup 4 between counters 15 and 16. That gap allows counters 15 and 16 to conform to a tilting heel more easily than would be possible if heel cup 4 had a single counter surrounding the entire heel.

In some embodiments, heel cup 4 can be fabricated so that medial counter 16 is stiffer that lateral counter 15. This additional stiffness would permit medial counter 16 to provide additional medial side support. Although a stiffer medial counter would be less able to conform to the shape of a wearer's foot, the reduced height of the medial counter would help to reduce potential discomfort from that additional stiffness. Medial counter 16 could be made stiffer using various techniques. As but one example, heel cup 4 could be molded so that medial counter 16 is thicker than lateral counter 15. As another example, medial counter 16 could be reinforced with an outer (or inner) layer of stiffer material.

Figure 6:
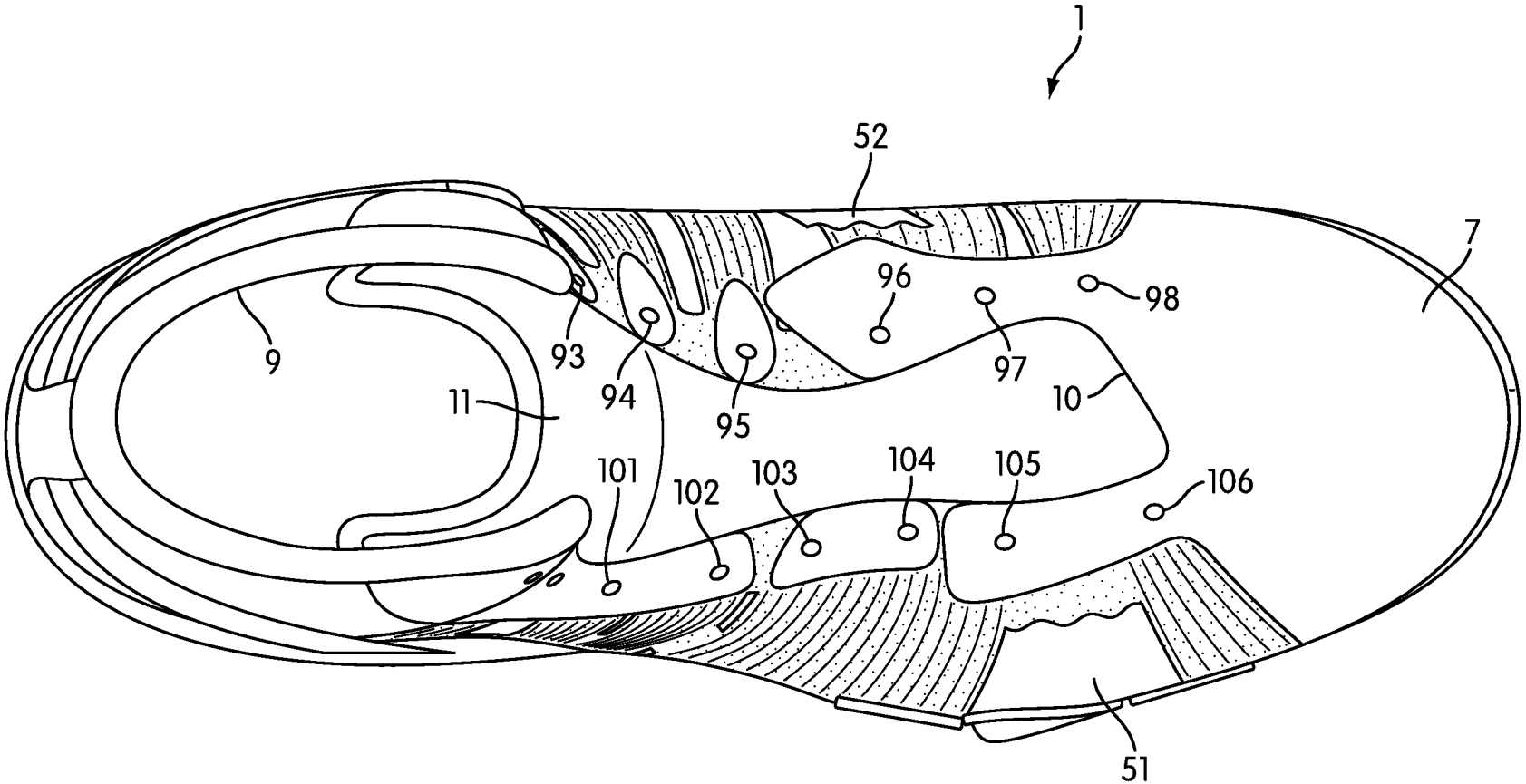
FIG. 6 is a top view of the from FIG. 1A, but with a portion of the forward strap removed.

In some embodiments, and as shown in FIG. 6, lacing eyelets in shoe 1 are arranged asymmetrically. FIG. 6 is a top view of shoe 1 similar to FIG. 1D, but with a portion of forward strap 50 removed. As seen in FIG. 6, eyelets 93-98 are somewhat closer together than eyelets 101-106 and shifted rearward. Eyelet 101 is further forward than eyelet 93, eyelet 102 is further forward than eyelet 94, etc. Many conventional eyelet arrangements are based on an assumption that forces during cutting movements are generally straight across a shoe. In many such arrangements, the eyelets are arranged symmetrically so as to result in a lacing pattern that criss-crosses the tongue opening at regular angles over the length of the tongue opening. However, it has been determined that cutting movements actually pull on an upper at different angles to the shoe. In many cases, the largest forces on the outside shoe during a cutting maneuver are generally parallel to the orientation of strap 50 (FIG. 1D) across the top of the foot. This line generally extends across the foot approximately from the proximal end of the first metatarsal to approximately the fifth proximal phalange. By asymmetrically arranging eyelets such as is shown in FIG. 6, forces on upper 2 can be better distributed and buckling of upper 2 reduced. In particular, and as can be seen by comparing FIGS. 6 and 1D, a strand of tightened lace 12 connecting eyelets 97 and 106 would be generally parallel to the direction of largest cut forces. Also generally parallel to those cut force lines would be strands of tightened lace 12 connecting eyelets 96 and 105, connecting eyelets 95 and 104, and connecting eyelets 94 and 103.

Although the above-described features of shoe 1 offer numerous potential advantages, shoes according to other embodiments may not include all of the above-described features. These and other embodiments may also include additional features or variations on features described above. For example, support plate 5 can be located inside of the upper under the midsole instead of outside the upper. As another example, a midsole could be located outside of the upper. As but another example, the lateral side of the collar could be lower than the medial side. In some embodiments, for example, the lateral hindfoot region of upper 2 is substantially lower than the medial hindfoot region and generally follows the upper edge of strap 80. In some embodiments, forward strap 50 may have a different configuration. Instead of securing medial strap 52 under the arch region as shown in FIGS. 1B and 1E, the terminal end of medial strap 52 could be secured under the heel, and strap 52 could extend from (or through) the medial front side of heel cup 4. In such an embodiment, a ring or loop could be included on medial strap 52, with lateral strap 51 then threading through that ring or loop and secured with hook and loop fasteners on lateral strap 51.

As explained above, medial tilting of the wearer W foot and ankle in the embodiments of FIGS. 1-6 pulls on strap 80. However, the free end 86 of strap 80 could be secured in other locations so as to create this pulling in response to medial tilting of the wearer W foot and ankle. In some embodiments, for example, the free end of strap 80 may extend across tongue opening 10 and be secured on the lateral side of the wearer foot. Similarly, in embodiments that include a medial counter support strap, the free end of such a support strap could be secured in various locations so as to create pulling in response to lateral tilting of the wearer foot and ankle.

The foregoing description of embodiments has been presented for purposes of illustration and description. The foregoing description is not intended to be exhaustive or to limit embodiments of the present invention to the precise form disclosed, and modifications and variations are possible in light of the above teachings or may be acquired from practice of various embodiments. The embodiments discussed herein were chosen and described in order to explain the principles and the nature of various embodiments and their practical application to enable one skilled in the art to make and use the present invention in various embodiments and with various modifications as are suited to the particular use contemplated. Any and all permutations of features from above-described embodiments are the within the scope of the invention. References in the claims to characteristics of a physical element relative to a wearer of claimed article, or relative to an activity performable while the claimed article is worn, do not require actual wearing of the article or performance of the referenced activity in order to satisfy the claim.

The invention claimed is:

1. An article of footwear comprising:
an upper;
a counter located at one of a lower lateral heel portion of the upper or a lower medial heel portion of the upper; and
a rear strap having a terminal end and a free end, wherein
the terminal end is fixed in a plantar heel region,
the free end is securable in a position at a forward ankle portion of the upper,
the rear strap extends upward and rearward across the counter, upward and around a rear of the upper, and upward and across a medial hindfoot portion of the upper when the free end is secured, and
the rear strap is movable relative to the counter and the rear of the upper.

2. The article of footwear of claim 1, wherein the counter is located at a lower lateral heel portion of the upper and the free end is securable in a position at a forward medial ankle portion of the upper.

3. The article of footwear of claim 1, wherein the counter is located at a lower lateral heel portion of the upper and the free end is securable in a position at a forward lateral ankle portion of the upper.

4. The article of footwear of claim 1, wherein the counter is a lateral counter located a lower lateral heel portion of the upper, and further comprising a medial counter located at a lower medial heel portion of the upper, wherein the lateral counter has a peak located higher than a peak of the medial counter.

5. The article of footwear of claim 4, wherein the medial counter peak is more rearwardly located than the lateral counter peak.

6. The article of footwear of claim 1, further comprising a heel cup, and wherein
the counter is a lateral counter portion of the heel cup,
the heel cup further includes a medial counter located at a lower medial heel portion of the upper,
the heel cup is compressible, and
the heel cup extends under a footbed.

7. The article of footwear of claim 6, wherein the lateral counter has a peak located higher than a peak of the medial counter.

8. The article of footwear of claim 1, further comprising a forward strap securable over a forefoot portion of the upper.

9. The article of footwear of claim 1, further comprising a support plate, wherein the support plate
extends through a plantar arch region and through a portion of a forefoot region,
includes a plurality of upward extensions on a lateral side of the article, and
includes a laterally-facing opening in the forefoot region.

10. The article of footwear of claim 9, wherein the opening has a center displaced from a rearmost portion of the article along a longitudinal centerline of the article by a distance that is approximately 70% of a heel-to-toe length of the article.

11. The article of footwear of claim 9, wherein the opening is located in forefoot region plantar and edge portions of the support plate and includes a corner generally positioned in a first metatarsal head region.

12. An article of footwear comprising:
an upper;
a lateral counter located at a lateral heel portion of the upper;
a medial counter located at a medial heel portion of the upper, the medial counter having a peak located higher than a peak of the lateral counter; and
a rear strap extending across a substantial portion of one of the medial and lateral counters and securable in a wrapped position extending upward and around a rear of the upper and upward across a hindfoot portion of the upper on a side opposite the one of the medial and lateral counters.

13. The article of footwear of claim 12, wherein the medial counter peak is more rearwardly located than the lateral counter peak.

14. The article of footwear of claim 12, wherein the rear strap is movable relative to the one of the medial and lateral counters and relative to the rear of the upper.

15. The article of footwear of claim 12, further comprising a heel cup, and wherein
the lateral counter and the medial counter are upward extensions of the heel cup,
the heel cup is compressible, and
the heel cup extends under a footbed.

16. The article of footwear of claim 12, further comprising a support plate, wherein the support plate extends through a plantar arch region and through a portion of a forefoot region, includes a plurality of upward extensions on a lateral side of the article, and includes a laterally-facing opening in the forefoot region.

17. The article of footwear of claim 16, wherein the opening has a center displaced from a rearmost portion of the article along a longitudinal centerline of the article by a distance that is approximately 70% of a heel-to-toe length of the article.

18. The article of footwear of claim 12, further comprising a forward strap securable over a forefoot portion of the upper.

19. The article of footwear of claim 18, wherein a lateral side of the forward strap is more forwardly located than a medial side of the forward strap.

20. The article of footwear of claim 12, further comprising a compressible midsole located at least partially inside the upper and having a raised lateral edge.

21. The article of footwear of claim 20, wherein only a bottom surface of the midsole is bonded to the upper.

22. The article of footwear of claim 16, wherein the opening is located in forefoot region plantar and edge portions of the support plate and includes a corner generally positioned in a first metatarsal head region.

* * * * *